US010994811B1

(12) United States Patent
Smith

(10) Patent No.: US 10,994,811 B1
(45) Date of Patent: May 4, 2021

(54) POWER POLE ACTUATOR MOUNT

(71) Applicant: Precision Welding & Fabrication, LLC, Rainbow City, AL (US)

(72) Inventor: Jeremy Smith, Southside, AL (US)

(73) Assignee: Precision Welding & Fabrication, LLC, Rainbow City, AL (US)

( * ) Notice: Subject to any disclaimer, the term of this patent is extended or adjusted under 35 U.S.C. 154(b) by 0 days.

(21) Appl. No.: 16/673,844

(22) Filed: Nov. 4, 2019

(51) Int. Cl.
*B63B 21/26* (2006.01)

(52) U.S. Cl.
CPC ..... *B63B 21/26* (2013.01)

(58) Field of Classification Search
CPC ..... B63B 21/26
See application file for complete search history.

(56) References Cited

U.S. PATENT DOCUMENTS

| | | | | |
|---|---|---|---|---|
| 4,565,529 | A | 1/1986 | Aertker | |
| 6,041,730 | A * | 3/2000 | Oliverio | B63B 21/26 114/230.13 |
| 7,104,212 | B2 | 9/2006 | Brianza | |
| 8,051,789 | B1 * | 11/2011 | Tylisz | B63B 21/22 114/230.1 |
| 8,327,791 | B1 | 12/2012 | Cullom | |
| 8,393,288 | B1 | 3/2013 | Ramsey | |
| 8,550,023 | B1 * | 10/2013 | Quail | B63B 21/26 114/294 |
| 8,661,999 | B2 | 3/2014 | Blom | |
| 8,839,730 | B2 * | 9/2014 | Shamblin | B63H 25/44 114/162 |
| 8,943,990 | B2 * | 2/2015 | McQuade | B63B 21/24 114/230.16 |
| 9,187,152 | B2 | 11/2015 | Bailey | |
| 9,517,827 | B2 * | 12/2016 | Shamblin | B63H 25/06 |
| 9,663,191 | B2 * | 5/2017 | Cromartie | B63B 21/26 |
| 9,745,022 | B1 * | 8/2017 | Kuenzel | B63B 21/26 |
| 9,969,468 | B2 * | 5/2018 | Price, III | B63B 21/26 |
| 10,029,764 | B2 * | 7/2018 | Bernloehr | B63B 21/24 |
| 10,526,050 | B1 * | 1/2020 | Turek | B63B 21/26 |
| 2009/0293793 | A1 * | 12/2009 | Silver | B63B 21/26 114/294 |
| 2011/0107952 | A1 | 5/2011 | Nicholson, IV | |
| 2011/0212691 | A1 * | 9/2011 | Rott | H04B 1/3827 455/41.3 |

OTHER PUBLICATIONS

Transom Mount Kayak Motors, Kayak Transom Motors for Power Pole Ready Kayaks, Internet site, www.islandhopperoutboards.com/transome-motor-for-power-pole-ready-kayaks.html, pp. 1-4.

(Continued)

*Primary Examiner* — S. Joseph Morano
*Assistant Examiner* — Jovon E Hayes
(74) *Attorney, Agent, or Firm* — Dennen IP Law, LLC

(57) ABSTRACT

A power pole actuator having a frame, the frame having at least one top plate and at least one opening. The power pole actuator further has a button coupled to the at least one opening, the button electrically coupled to a power pole controller such that when the button is depressed, a power pole moves upward or downward.

11 Claims, 3 Drawing Sheets

(56) References Cited

OTHER PUBLICATIONS

Nik Brown, If the Bass Boats can do it, so can I! Dual Power-Poles-Jackson Kayak, Internet Site, jacksonkayak.com/blog/2015/12/16/bass-boats-can-can-dual-power-poles, Dec. 16, 2015, pp. 1-8.
Micro Anchor, Big Power in a Small Package, Internet Site, www.power-pole.com/micro, pp. 1-9.
Blade, Power-Pole Blade, Internet Site, www.power-pole.com/products/shallow-water-anchors/blade-edition-cm2, pp. 1-9.
West Marine, Power-Pole Remote Control Kit, Internet Site, www.westmarine.com/buy/power-pole—remote-control-kit-10202992, pp. 1-5.

* cited by examiner

POWER POLE ACTUATOR MOUNT

BACKGROUND

Fishing is a sport that serves as a leisure activity across the world, and for some individuals fishing is their favorite pastime that provides hours of enjoyment. Some fisherman considers the fishing pastime as a hobby of sorts.

Some fishermen fish from the shores of a body of water. However, many fishermen fish from powerboats. There are many types of powerboats from which fisherman fish. One boat is a bass boat that is designed specifically for bass fishing on inland lakes and rivers.

Some bass boats have power poles one on each side of a motor that is coupled to the stern (the back of the boat). The power poles provide a shallow-water anchor system. In this regard, the power poles use electrical and hydraulic power system to lock a bottom in place in shallow water, e.g., under ten (10) feet deep. Thus, if a fisherman comes across an area at which the fisherman desires to stay and fish for an extended time, the fisherman drops the power poles, and the power poles lock the boat in place. The power poles keep the boat from drifting due to wind or otherwise.

The bass boats further comprise generally hull having a stern (the back of the boat) and a bow (the front of the boat). The bass boats comprise a trolling motor on a deck of the boat toward the bow. Thus, while the fisherman is fishing, he can create movement in the bass boat by applying pressure to the trolling motor.

The bass boats often have power pole actuators that control the up and down movement of the power poles. It is typically located on the deck next to the trolling motor. Often, while the fisherman is trolling by applying pressure to the trolling motor, the fisherman may want to activate the power poles so that they move downward, into the water, and couple to the bed of the body of water.

Frequently, a fisherman may be trolling the water using the trolling motor. The fisherman often looks for a portion of water in which he desires to fish. While applying pressure with his/her foot to the trolling motor, the fisherman may mistakenly apply pressure to the power pole actuators even thought the fisherman does not desire to stay in the particular area.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure describes a power pole actuator system having a power pole actuator configured to be conveniently located on a boat. The power pole actuator has a substantially rectangular frame with an open front. On a top surface of the power pole actuator is at least one button that is electrically coupled to a power pole control system. The power pole actuator is coupled to a wall of a bow of the boat. Thus, when a fisherman of the boat desires to actuate the power poles, using his foot, he presses the button, and the power poles move downwardly till they are contacting the bed of the body of water.

Additionally, the power pole actuator has two substantially rectangular tabs integral with and extending from the top surface of the frame. The inner walls of the openings taper inwardly toward the bottoms of the openings. These opening may be used to store tools while not in use, e.g., pliers.

Figure 1:
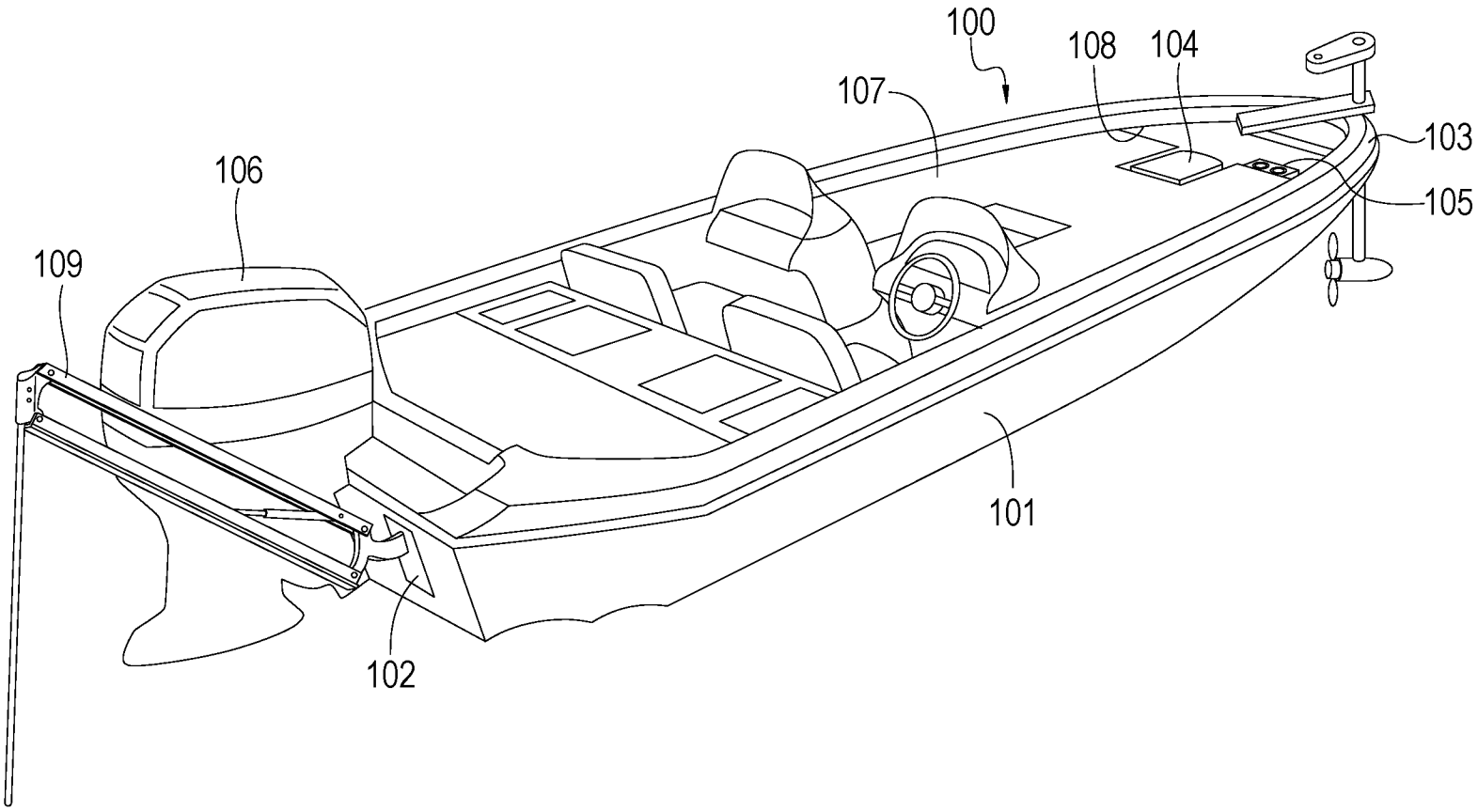
FIG. 1 is a perspective view of a boat using an exemplary power pole actuator system in accordance with an embodiment of the present disclosure.

FIG. 1 is a perspective view of a boat 100 using an exemplary power pole actuator system in accordance with an embodiment of the present disclosure. The boat comprises a hull 101, and a back of the boat is called a stern 102 and the front of the boat is a bow 103. Atop the boat is a deck 107.

The boat 100 further comprises a motor 106 that controls movement of the boat 100. In addition, the boat 100 comprises a trolling motor 108 for moving the boat 100 through the water quietly, to avoid spooking fish.

The exemplary power pole actuator system comprises a power pole controller (not shown) that is typically stored within the hull and coupled to a power pole 109. Further, the power pole actuator system comprises a power pole actuator 105. The power pole actuator 105 is coupled to an inner wall of the bow 103. Thus, it is behind the fisherman and elevated from the floor of the indentation 108 so that the fisherman won't accidently lower the power pole 109.

During operation, the fisherman (not shown) uses the trolling motor 104 to move through the water. As he/she is trolling through the water, he chooses an area in which the fisherman desires to fish. The fisherman reaches with his/her foot to his/her right and activates the power pole actuator 105. The power pole actuator 105 sends a signal to the power pole controller (not shown), and the power poles lower, locking the boat in place so the fisherman can fish.

Figure 2:
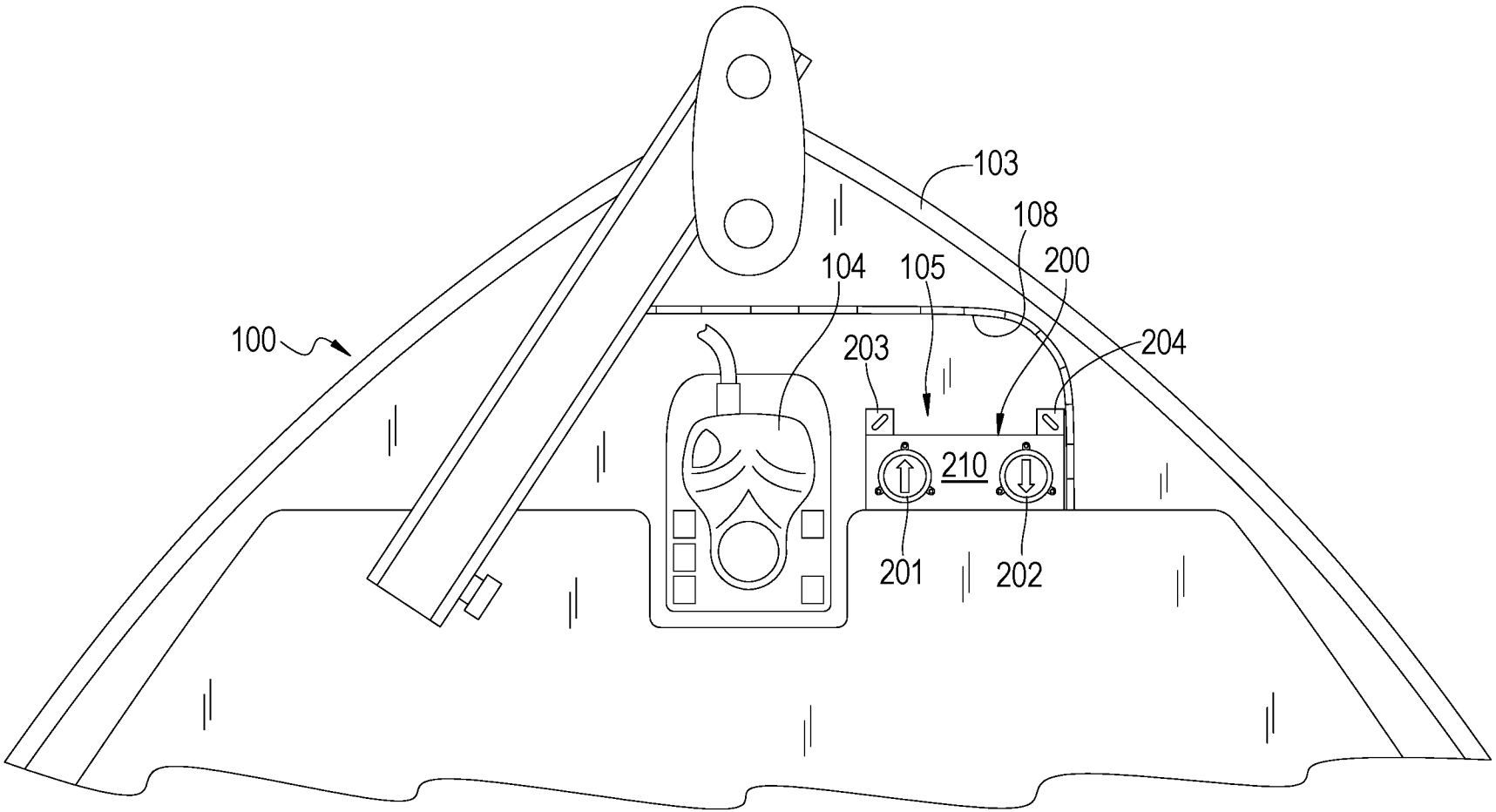
FIG. 2 is a top plan view of a bow of the boat coupled to a power pole actuator of the power pole actuator system of FIG. 1.

FIG. 2 is a top plan view of the bow 103 of the boat 100 coupled to a power pole actuator 105 of the power pole actuator system. At the bow 103 of the boat 100 is the indentation 108. On the floor of the indentation 108 is a trolling motor 104.

The exemplary power pole actuator 105 comprises a frame 200. The frame 200 is substantially rectangular. Further, the power pole actuator 105 comprises two buttons. In this regard, the power pole actuator comprises an up-arrow button 202 and a down-arrow button 201 coupled to openings (not shown) in a top plate 205 of the frame 200.

In use, the fisherman places his/her foot on the trolling motor 104 to move the oat about on the water. The fisherman is looking for an area of water having characteristics of an acceptable place to fish. The fisherman identifies an area of water desirable for fishing, the fisherman using his/her foot selects the down-arrow button 201. When pressed, the power pole controller (not shown) lowers the power pole 109 into the water and lower it until it reaches the bed of the water (not shown). When the fisherman is done fishing in the area, the fisherman presses the up-arrow button 202 with his/her foot. Once the power pole 109 is positioned out of the water, the fisherman can continue with moving the boat 100.

Note that the power pole actuator 105 comprises two tabs 203 and 204. These tabs 203 and 204 are integral with and project from the top 205 of the frame 200. Each tab 203 and 204 have an opening (not shown) in which tools, e.g., pliers, may be stored when not in use. Further note that the inside walls of the openings taper inward toward the bottom of the opening to further secure the tools when present.

Figure 3:
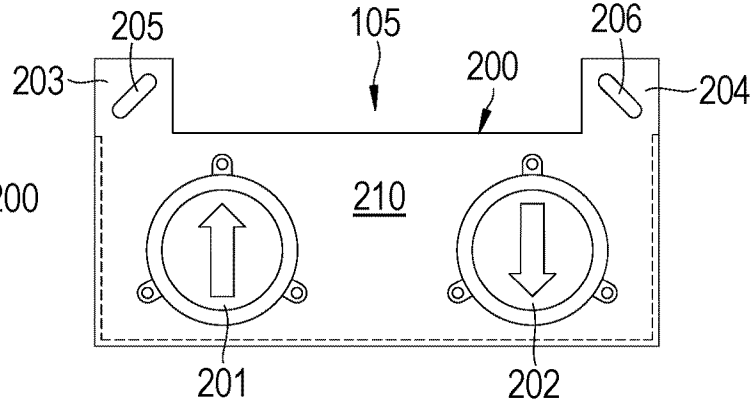
FIG. 3 is an exemplary right-side view of the power pole actuator of FIG. 2.

FIG. 3 is an exemplary left-side view of the power pole actuator 105. The frame 200 comprises a left-side plate 400 integral with a back plate 600. A front edge 401 of the right-side plate 400 angularly extends from the top plate 205 of the frame downward toward the back plate 600. Within the frame is the button 201. Further, the tab 203 extends from the top plate 205 and comprises an opening (not shown) for holding tools.

Figure 4:
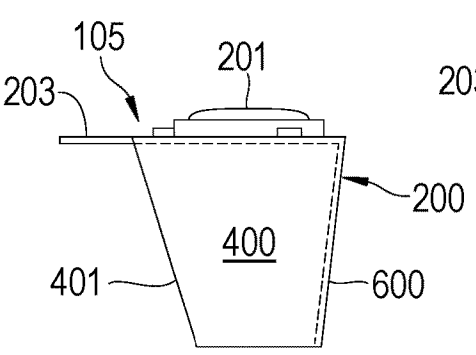
FIG. 4 is a top plan view of the power pole actuator of FIG. 2.

FIG. 4 is a top plan view of the power pole actuator 105. The power pole actuator 105 comprises the frame 200. The frame 200 comprises the top plate 205. In openings (not shown) in the top plate 205 is the up-button 202 and the down-button 201. The power pole actuator 105 further comprises tabs 203 and 204 that are integral with and protrude from the top plate 205. Within each tab 203 and 204 is an opening 205 and 206, respectively. The openings are for holding tools while not in use.

Figure 5:
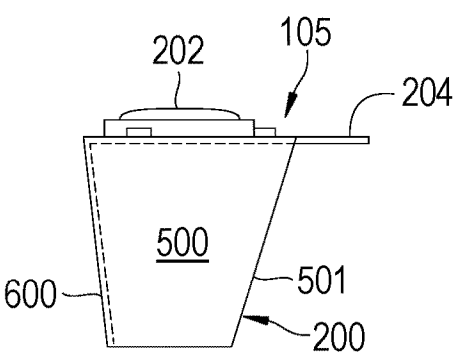
FIG. 5 is an exemplary left-side view of the power pole actuator of FIG. 2.

FIG. 5 is an exemplary right-side view of the power pole actuator 105. The frame 200 comprises a left-side plate 500 integral with the back plate 600. A front edge 501 of the left-side plate 500 angularly extends from the top plate 205 of the frame downward toward the back plate 600. Within the frame is the up-button 202. Further, the tab 204 extends from the top plate 205 and comprises an opening (not shown) for holding tools.

Figure 6:
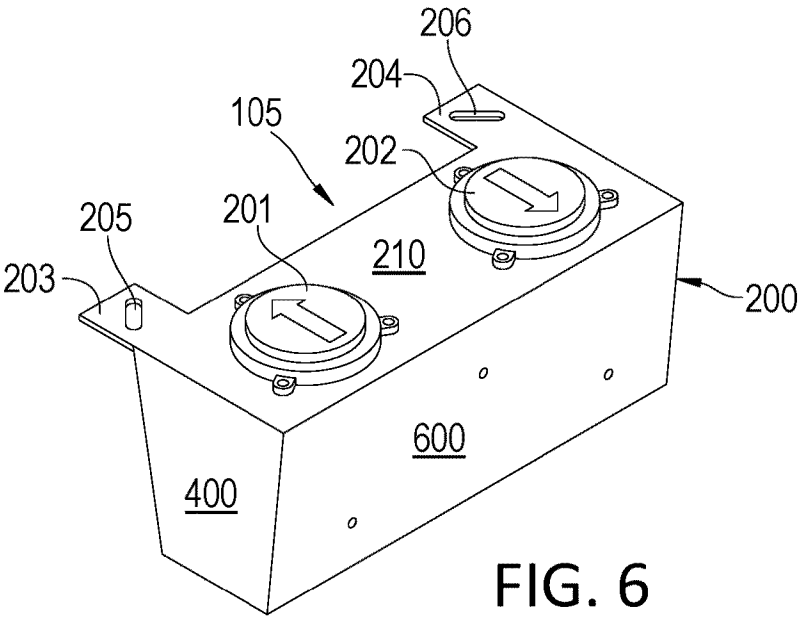
FIG. 6 is a right-side perspective view of the power pole actuator of FIG. 2.

FIG. 6 is a left-side perspective view of the power pole actuator 105. Shown is the left-side plate 400 integral with the back plate 600, which is part of the frame 200. The frame 200 further comprises the right-side plate 500 (not shown) integral with the back plate 600. Within the frame are the button 202 and the button 201. Further, the tabs 203 and 204 extend from the top plate 205 and comprises openings 205 and 206, respectively, for holding tools (not shown).

The back plate 600 may comprise openings. The back plate 600 may be coupled to the inner wall of the bow 103 (FIG. 2) by inserting fasteners through the opening.

Figure 7:
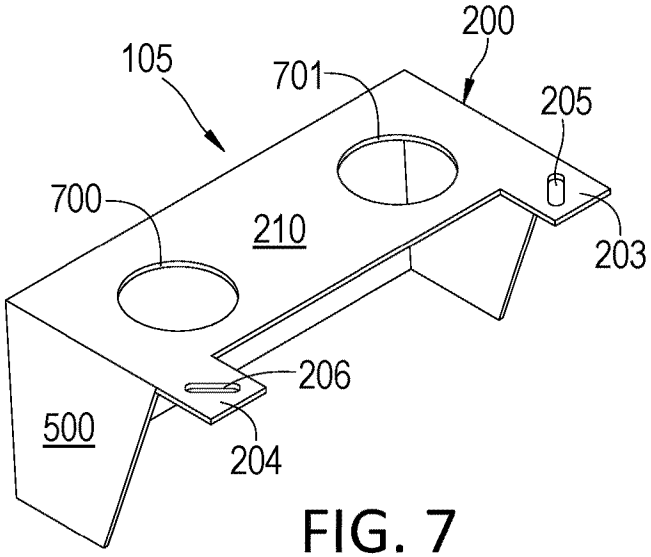
FIG. 7 is a left-side perspective view of a frame of the power pole actuator of FIG. 2.

FIG. 7 is a right-side perspective view of the frame 200 of the power pole actuator 105. The frame has side plates 501 and 401 (not shown). The side plates 501 and 401 are integral with the back plate 600 (not shown). Further integral with the side plates 501 and 401 and the back plate 600 is the top plate 210. Top plate 210 comprises two openings 700 and 701. Down-arrow button 201 couples to opening 700, and up-arrow button 202 couples to opening 701.

Further, tabs 203 and 204 extend from the top plate 206. The tabs 203 and 204 have openings 206 and 205 formed therein for holding implements like tools, e.g., pliers. Note that the inside walls of the openings taper decreasingly in size from the top to the bottom of the opening for structurally holding the implements within the openings 206 and 205.

What I claim is:

1. A power pole actuator mount, comprising:

a frame having a substantially rectangular top plate and a substantially rectangular back plate wherein the top plate is integral with the back plate, the frame further having left-side plate integral with the back plate and the top plate, and the left-side plate angularly extends from the top plate downward to the back plate, and the frame further comprises a right-side plate integral with the top plate and the back plate that angularly extends from the top plate downward to the back plate, wherein the top plate comprises a first opening, the back plate of the frame configured for coupling to an inner wall of a bow of a boat, the frame is positioned flush with a deck of the bow so that a user can easily access the frame with his/her foot;

a first button coupled to the first opening, the first button configured to transmit a signal to a power pole controller of the boat such that when the first button is depressed, a power pole moves upward or downward, the first button coupled to the inside wall of the bow so that a user can easily depress the first button with his/her foot.

2. The power pole actuator of claim 1, wherein the frame comprises two openings.

3. The power pole actuator of claim 2, wherein a second button is coupled to a second opening.

4. The power pole actuator of claim 3, wherein the first button when actuated moves the power pole up.

5. The power pole actuator of claim 3, wherein the second button when actuated moves the power pole down.

6. The power pole actuator of claim 1, wherein the top plate comprises a first tab.

7. The power pole actuator of claim 6, wherein the first tab comprises a first opening for receiving tools.

8. The power pole actuator of claim 1, wherein the top plate comprises a second tab.

9. The power pole actuator of claim 8, wherein the second tab comprises a second opening for receiving tools.

10. The power pole actuator of claim 1, wherein the back plate comprises openings for receiving fasteners.

11. The power pole actuator of claim 10, wherein the power pole actuator is coupled to the inner wall of the bow of the boat via the openings and the fasteners.

* * * * *